US005439325A

United States Patent [19]

Kitchen

[11] Patent Number: 5,439,325

[45] Date of Patent: Aug. 8, 1995

[54] VARIABLE YIELDING MINING CRIB SUPPORT COLUMN

[75] Inventor: Chris D. Kitchen, Springville, Utah

[73] Assignee: Mountainland Support, Inc., Provo, Utah

[21] Appl. No.: 229,128

[22] Filed: Apr. 18, 1994

Related U.S. Application Data

[63] Continuation-in-part of Ser. No. 23,618, Feb. 26, 1993, Pat. No. 5,342,150.

[51] Int. Cl.[6] ..... E21D 11/00

[52] U.S. Cl. ..... 405/288; 248/357; 405/303

[58] Field of Search ..... 405/288, 289, 303, 290; 248/354.1, 357, 635; 264/109, 45.3

[56] References Cited

U.S. PATENT DOCUMENTS

| | | | |
|---|---|---|---|
| 931,466 | 8/1909 | Nellen | 405/288 X |
| 4,194,997 | 3/1980 | Edler | 264/109 X |
| 4,195,111 | 3/1980 | Rautenbach | 405/288 |
| 4,267,222 | 5/1981 | Sanders | 52/309.14 X |
| 4,565,469 | 1/1986 | Chlumecky | 405/288 |
| 5,143,484 | 9/1992 | Deul | 405/288 |

*Primary Examiner*—Dennis L. Taylor
*Attorney, Agent, or Firm*—K. S. Cornaby

[57] ABSTRACT

A roof support column used as a support between the roof and floor of a mine comprises a stacked series of hollow roof support cribs containing a mixture of light-weight aggregate such as volcanic lava, tuft or pumice, and a chemical foam contained in one chamber of a triple-walled high density paper tubing. The other chamber has honeycomb material therein. The combination of these materials results in a roof support crib which has the yielding characteristics of wood. Such cribs called variable yielding cribs are stacked and locked on top of one another to form a vertical cylindrical cribbing support column.

6 Claims, 5 Drawing Sheets

VARIABLE YIELDING MINING CRIB SUPPORT COLUMN

BACKGROUND OF THE INVENTION

This is a continuation-in-part of allowed U.S. patent application Ser. No. 08/023,618 filed Feb. 26, 1993 now U.S. pat. No. 5,342,150.

This invention relates to a variably yielding mine support crib column for supporting the roof of a mine.

For decades wooden cribs have been used to support the roof in mines. Typically the wood cribs are 8"×8" and 2' to 8' high. These cribs are stacked vertically to form column supports. Such cribs are usually between 40–100 pounds each in weight, and are typically cut from lodge-pole pine or oak.

Normally, wood cribs are transported by vehicle as far into the mine as possible. They are then carried by hand to their destination, which is, of course, very labor intensive. This is due to the fact that 24 wood cribs are needed to stack an 8 foot high column.

Another problem with wood cribs is that the cribs are not tied together. When a roof moves or shifts relative to the floor, a wood crib column cannot sustain non-lateral movement. The top cribs begin to roll and the column begins to fail.

A wooden crib's ultimate load bearing capacity can be significantly affected by the localized behavior of one timber within a crib. For example, if one wood crib has rotten timber or is taken from a weak part of the tree, it is in the weakest part of the column. The entire column is only as strong as the one weak crib. The compressive properties of wood are also dependent upon the wood's moisture content and grain orientation.

It is therefore an objective of this invention to provide a roof support column structure that will sustain lateral shifts in the roof and is of uniform construction.

As wood cribs become more scarce, the need for an alternative becomes a necessity. Such an alternative should insure an endless supply of support materials superior to that of wood, and at prices competitive m wood even before installation and transportation costs are considered.

An alternative to wooden cribs should be lighter in weight and easier to handle than conventional wooden cribs. Such an alternative should have the added advantage of being rollable when necessary to install in remote locations in the mine.

SUMMARY OF INVENTION

A roof supporting crib column of the invention has a preferably hollow cylindrical construction with a double-walled high-density paper tube defining the circumference of the crib. A light weight aggregate, such as crushed lava stone and a chemical foam, such as polyurethane, are contained within the double wall of the paper tube. A preferred dimension of the crib of the invention is approximately 16 inches in height with a diameter of three (3) feet or less.

A variable yielding crib constructed according to the invention can be manufactured to meet a wide range of needs from that of a "lesser strength, higher yield" to a "lower yield, higher strength" support. The crib can be made to parallel the compression curve of wood.

Twenty-four (24) trips are needed to build one crib support 8 feet high using wooden cribs. With the present crib, it only takes 3 trips to assemble an 8-foot high support. Using a cylindrical preferred construction, the cribs can be rolled into the mine, two at a time. One crib is preferably 16 inches tall and can replace 4 to 6 wooden cribs.

The cribs are interlocking. The paper tube construction locks the cribs together producing a self-supporting column virtually unaffected by perpendicular roof movement.

Alternatively, the cribs of varying diameters can be stacked inside of one another to produce a very high crush strength. Stacking cribs together can generate over 350,000 pounds on initial yield.

A high volume of air is needed in a typical mine for ventilation. The preferred cylindrical construction of the crib allows air to flow more easily into the mine.

Many times it becomes necessary to move a mechanical miner through a crib column. A wooden crib can become caught and disrupt the miner, causing hours of downtime. The present crib construction provides ease of cutting through the crib, virtually eliminating any downtime.

THE DRAWINGS

A preferred embodiment of the invention is illustrated in the accompanying drawings, in which:

FIG. 1 is a side elevational section of a vertical column of variable yielding cribs of the invention;

FIG. 2, a top plan view of a crib taken along lines 2—2 of FIG. 1;

FIG. 3, a side elevational section of a variable yielding crib of the invention;

DETAILED DESCRIPTION OF THE PREFERRED EMBODIMENT

Figure 1:
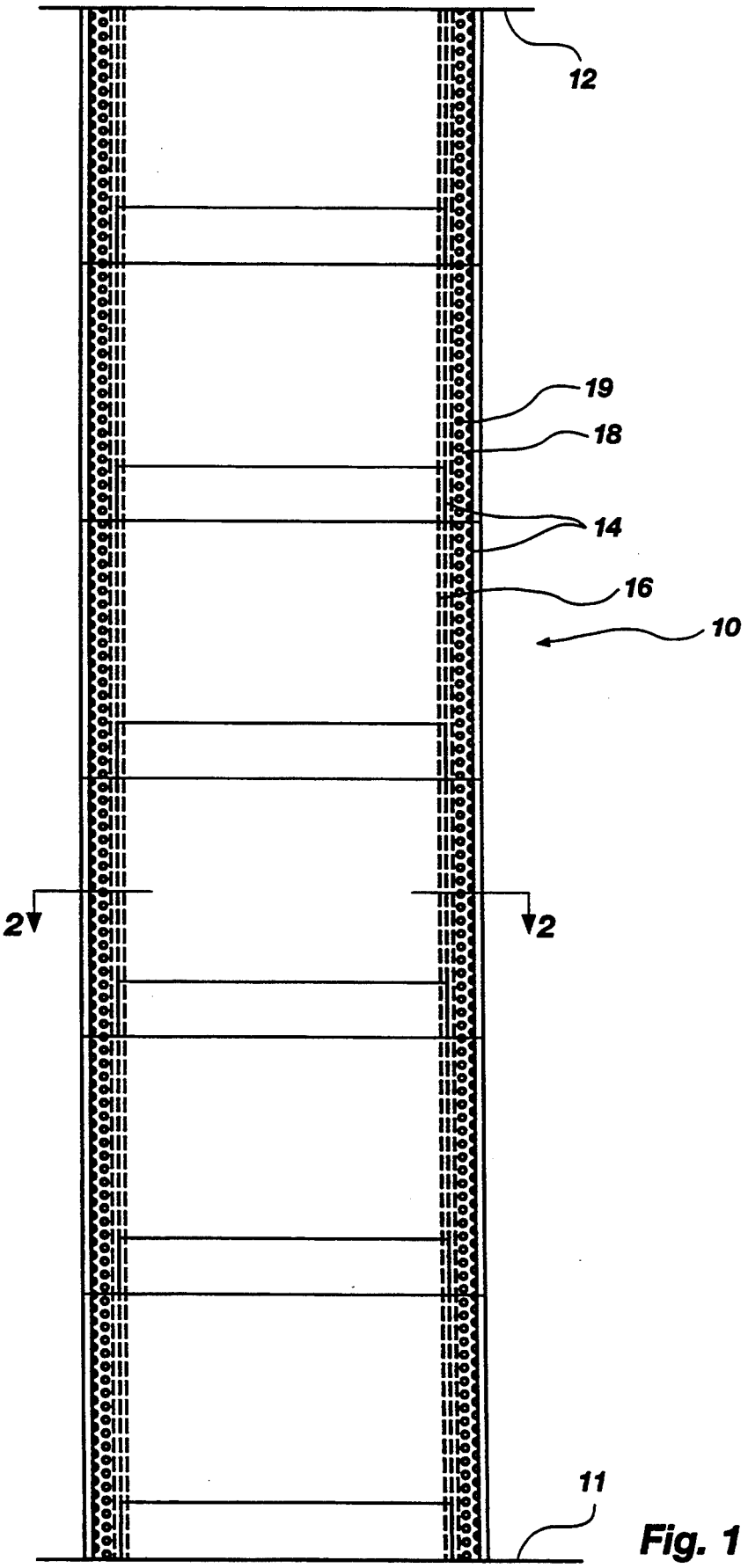
Figure 2:
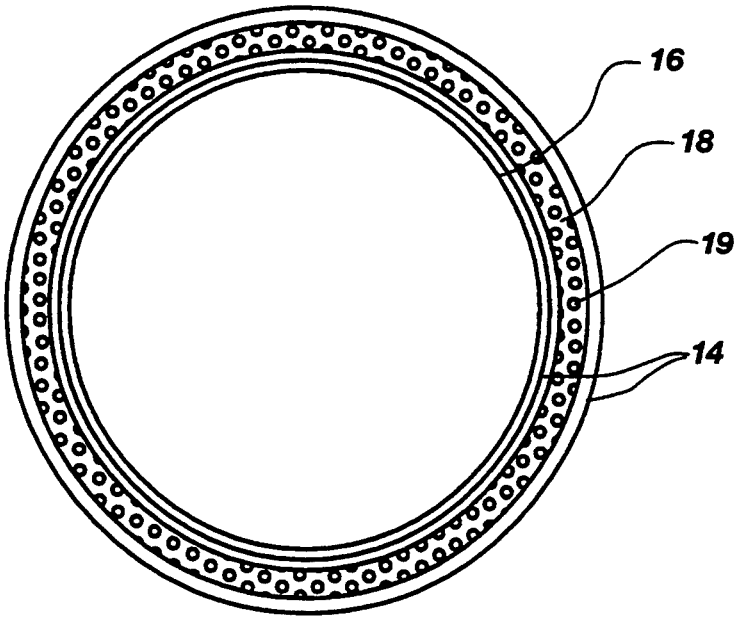
Figure 3:
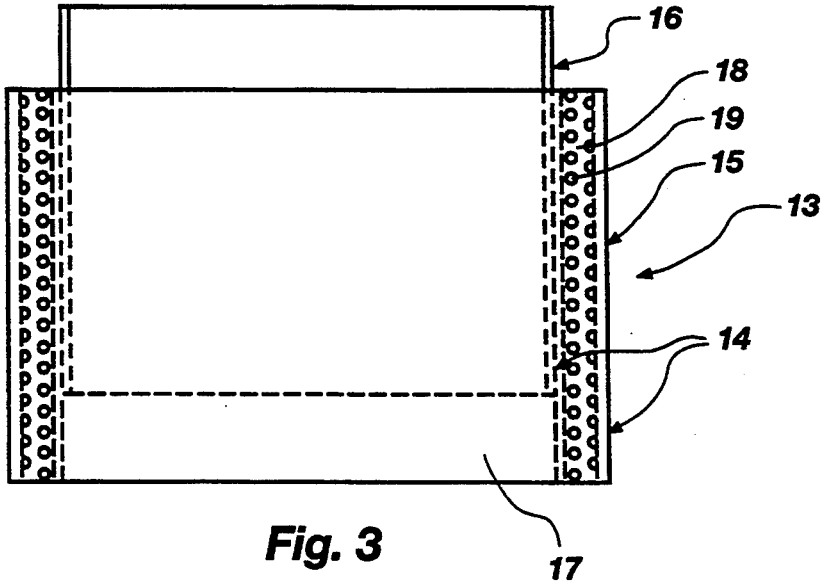

As shown in FIGS. 1 and 2, a preferred embodiment of the invention has vertical column 10 of stacked cribs in a typical mine resting upon the mine floor 11 and supporting a mine roof 12. FIG. 3 illustrates an individual cylindrical crib 13 which is hollow in cross section.

The construction of the crib 13 and column 10 has an outer double-walled shell or tube 14 preferably constructed of high density paper or pressed wood product. Tube 14 forms the support structure for the crib 13. Tube 14 is placed in both tension and compression in the event of a mine roof 12 lateral shift or vertical collapse. The tube 14 is somewhat fire retardant, in that in the event of a fire, the outer surface of the tube 14 chars and reduces the tendency of the fire to further penetrate the crib 13. The surface of the tube 14 can also be painted with a fire-retardant paint 15 to further protect the crib 13 from fire damage.

Crib 13 is so constructed to show in FIG. 3, that an inner interlocking tube 16, composed preferably of high density paper or pressed wood, extends through the interior surface of crib 13 and is slideably mounted next to the inner surface of tube 14. Interlocking tube 16 typically extends above the upper surface of crib 13 to enter and engage a corresponding receptacle 17 in the lower end of a crib 13 disposed above in column 10. Thereby, a succession of vertically stacked cribs 13 can form a rigid structure or column 10 as shown in FIG. 1.

Interlocking tube 16 is slideably mounted in crib 13, so that the placement of interlocking tube 16 can determine how much of an interlock occurs with each successive crib 13 in the column 10. The extension of interlocking tube 16 upwardly above the surface of tube 14 creates a correspondingly sized aperture in the lower half of crib 13.

As shown in FIGS. 1, 2, and 3, tube 14 is filled with a polyurethane foam 18 and a rock aggregate 19 mixture which is positioned between the inner and outer walls of tube 14. This composite of foam 18 and aggregate 19 has physical properties similar to that of wood, specifically pine and other light-weight woods. The preferred density of the foam-aggregate composition is between 35 and 45 pounds per cubic foot of material.

Like wood, urethane foam is closed cell. Foam therefore, exhibits a similar form of static pressure during a compression test. This pressure is transferred throughout the column in both a vertical and horizontal manner. This type of crush characteristic allows the foam to be near perfect match for a wood replacement.

Various aggregates 19 can be used in the crib 13. For example, aggregates, such as lava ($SiO_2$) in its aerated form has physical properties similar to wood. The density of lava rock ranges typically from about 30 to 35 pounds per cubic foot of aggregate. Unlike the foam 18, aggregate rock 19 crushes and breaks at its yield point, whereas foam 18 has no recognizable yield in the compression range preferred for this invention.

Under pressure, as the lava 19 breaks up the lava's variable thickness continues to crush more completely as the pressure increases. By itself, i.e., in the absence of a matrix or binder, the compression yield of lava is very low during the initial phases of compression. Accordingly, lava rock without the polyurethane foam is virtually non-load bearing during the initial or usable crush ranges (the first 20–30% of its crush).

The fire retardant properties of polyurethane foam under normal conditions are fairly low, and the foam is flammable. However, the compressed packing in tube 14 with rock aggregate makes the composite very flame retardant, below 25 on the ASTM E-162 flame spread index.

The combination of tube 14 with the composite of foam 18 and aggregate 19 forms a very rigid structure. All components reinforce each other to create a unit stronger in compression than the sum of the individual components. The physical compression of the crib 13 is over twice that of the sum of the properties of the individual components.

Figure 4:
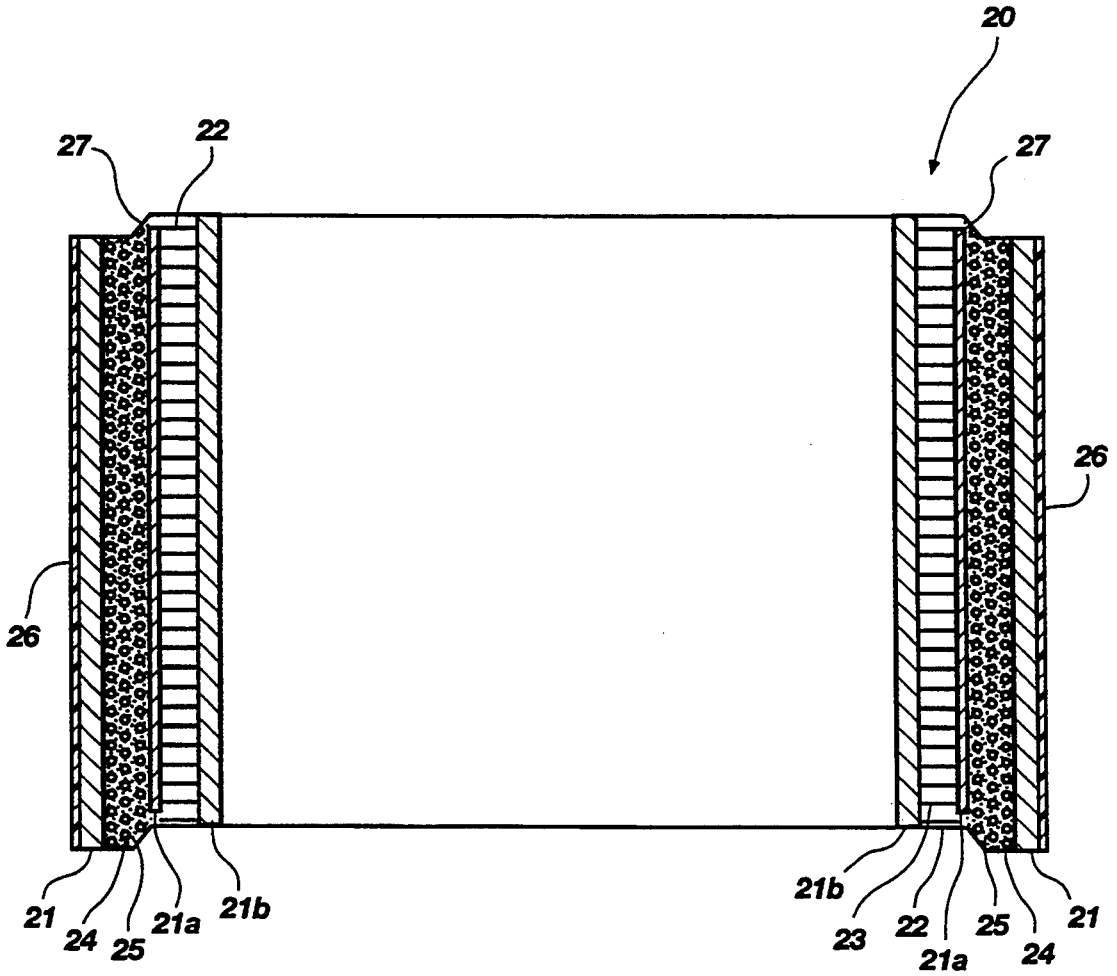
FIG. 4, is a side elevational section of another embodiment of the invention showing an interlocking circumferential element.

In FIG. 4, the construction of the new crib support column 20 is constructed of a triple-wall cylindrical shell or tube 21, 21*a*, 21*b*, preferably fabricated of high density paper or pressed wood. Tube 21 is placed in tension and compression, in the event of a mine roof or floor shift laterally, or vertical collapse.

The honeycomb element 22 is sandwiched between tube walls 21*a* and 21*b*. Inside each cell of honeycomb 22, 2.1 pounds of foam 23 is preferably used to bond tubes 21*a* and 21*b* together, thus making it one unit and creating an "I-Beam" effect. This strengthens the inside wall dramatically, thwarting implosion. Aggregate filler 24 is placed between tube wall 21 and 21*a*. A foam binder 25 intermixed with aggregate 24 together make the rock wall structure shown.

Column 20 has an outer fiberglass jacket 26. This increases the strength of the outside tube 21, creating a waterproof barrier. A step lock 27 is at approximately a 53 degree angle. This angle was chosen for its ability to remain stable when a lateral load is applied to the structure.

Figure 5:
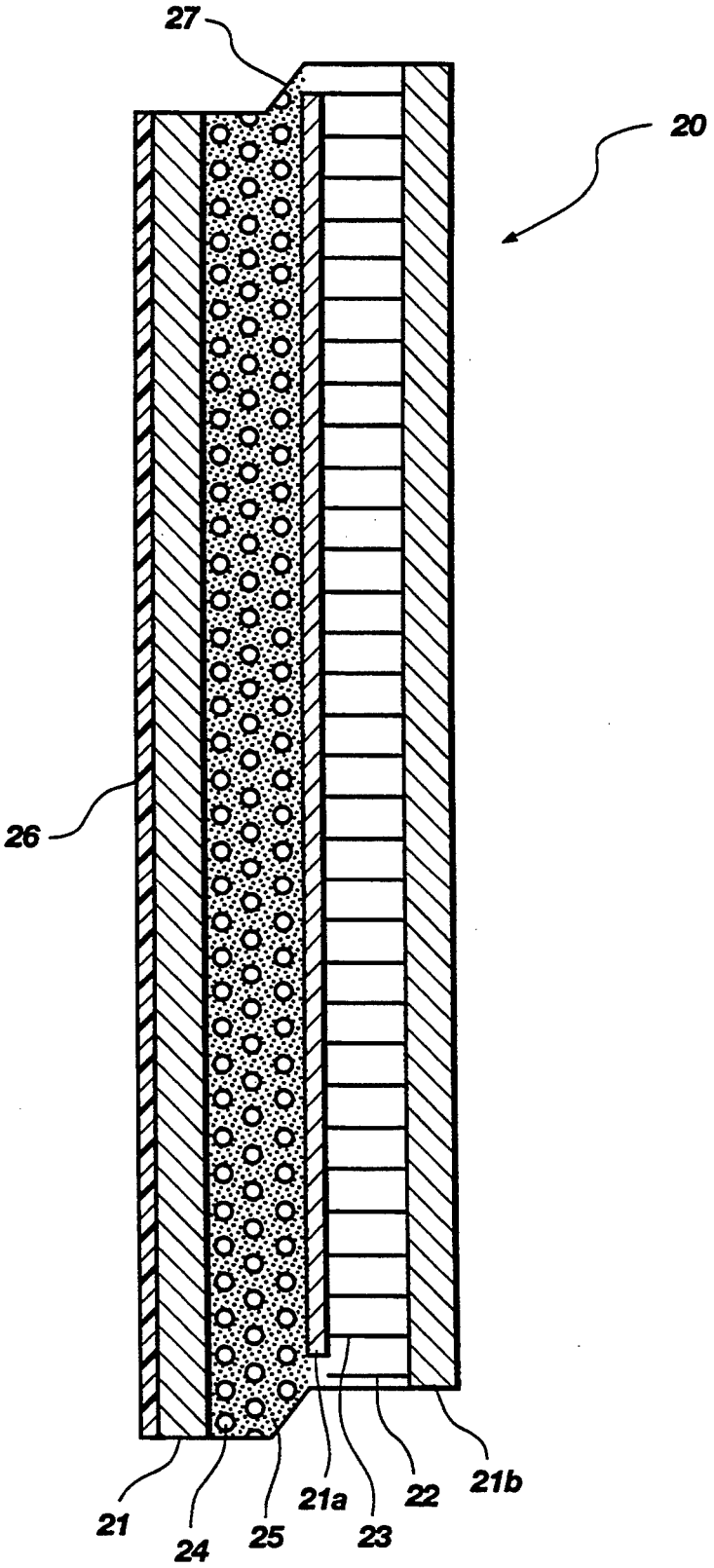
FIG. 5, is a side elevational section of the embodiment shown in FIG. 4.

FIG. 5 is a cutaway section of the crib column 20. Tubes 21, 21*a*, 21*b* are made of high density paper or pressed wood. The honeycomb 22 is sandwiched between tubes 21*a* and 21*b*. The 2.1 pound foam 23 that is shot in each cell with aggregate 24 to bond the three products together gives it the "I-Beam" properties. The foam binder 25 forms the rock-like wall. The fiberglass shell 26 strengthens the outside wall in tension, and creates the waterproof barrier.

Figure 6:
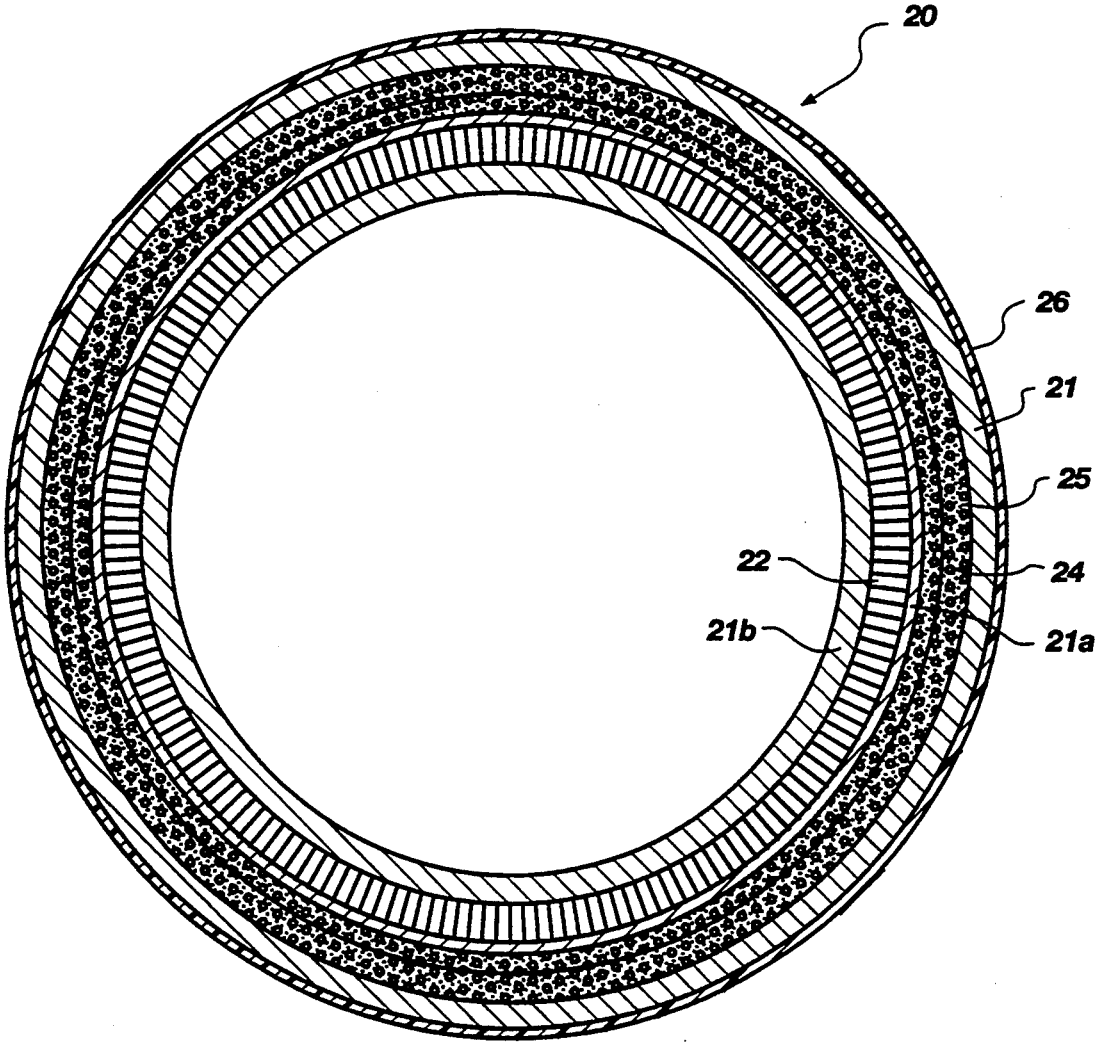
FIG. 6, is a top plan view of the embodiment shown in FIG. 4.

The FIG. 6 is a top view of the crib column 20 shown in the preceding FIGS. 4 and 5.

While this invention has been described and illustrated herein with respect to preferred embodiments, it is understood that alternative embodiments and substantial equivalents are included within the scope of the invention as defined by the appended claims.

I claim:

1. A collapsible crib for a mine roof support column, comprising in combination:

a triple-walled vertical support structure having a hollow center, said triple walls having an outer wall, a center wall and an inner wall in spaced-apart relationship with each other;

a composite material filling the aperture between the outer and center walls comprising a composite of urethane formable material and rock aggregate;

a honeycomb material filling the aperture between the inner and center walls;

an indent along the upper and lower ends of the triple-walled support structure for interlocking respectively the upper end of one support structure with the lower end of another support structure; and a fiberglass jacket surrounding the outer wall for waterproofing the support structure.

2. A collapsible crib as set forth in claim 1, wherein the outer, center and inner walls are constructed of high density paper.

3. A collapsible crib as set forth in claim 1, wherein the outer, center and inner walls are constructed of pressed wood.

4. A collapsible crib as set forth in claim 1, wherein said urethane formable material is polyurethane.

5. A collapsible crib as set forth in claim 1, wherein said rock aggregate is lava rock.

6. A collapsible crib as set forth in claim 1, wherein said triple-walled vertical support structure is cylindrical.

* * * * *